US011158934B2

(12) United States Patent
Han et al.

(10) Patent No.: US 11,158,934 B2
(45) Date of Patent: Oct. 26, 2021

(54) BASE STATION ANTENNA

(71) Applicant: AAC Technologies Pte. Ltd., Singapore (SG)

(72) Inventors: Hongjuan Han, Shenzhen (CN); Yuehua Yue, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 16/990,969

(22) Filed: Aug. 11, 2020

(65) Prior Publication Data

US 2021/0005957 A1 Jan. 7, 2021

Related U.S. Application Data

(63) Continuation of application No. PCT/CN2019/094411, filed on Jul. 2, 2019.

(51) Int. Cl.

| | |
|---|---|
| ***H01Q 1/24*** | (2006.01) |
| ***H01Q 5/35*** | (2015.01) |
| ***H01Q 3/26*** | (2006.01) |
| ***H01Q 3/36*** | (2006.01) |
| ***H01Q 21/08*** | (2006.01) |

(52) U.S. Cl.

CPC ..... *H01Q 1/246* (2013.01); *H01Q 3/2617* (2013.01); *H01Q 3/36* (2013.01); *H01Q 5/35* (2015.01); *H01Q 21/08* (2013.01)

(58) Field of Classification Search

CPC ..... H01Q 3/2617; H01Q 3/36; H01Q 3/2605; H01Q 3/267; H01Q 21/08; H01Q 21/26; H01Q 21/062; H01Q 21/00; H01Q 21/0006; H01Q 1/246

See application file for complete search history.

(56) References Cited

U.S. PATENT DOCUMENTS

| | | | | |
|---|---|---|---|---|
| 5,477,229 | A * | 12/1995 | Caille | H01Q 3/267 342/173 |
| 5,512,914 | A * | 4/1996 | Hadzoglou | H01Q 3/12 343/792 |
| 5,864,317 | A * | 1/1999 | Boe | H01Q 3/267 342/374 |
| 2002/0044099 | A1 * | 4/2002 | Yamamoto | H01Q 13/18 343/789 |

(Continued)

*Primary Examiner* — Lam T Mai

(74) *Attorney, Agent, or Firm* — W&G Law Group

(57) ABSTRACT

The present invention provides a base station antenna, which includes a plurality of radiating unit arrays, a plurality of feeding modules, and a calibrating module. Each radiating unit array includes a plurality of radiating units. Each feeding module includes a power division network and a radio frequency inlet, the power division network is configured for allocating an input power from the radio frequency inlet to each radiating unit of the radiating unit array. The calibrating module includes a plurality of directional couplers and combiners, a coupling end of each directional coupler connected with the radio frequency inlet is defined as a coupler input terminal, a coupling end of each directional coupler connected with the combiner is defined as a coupling terminal, and the calibrating module is configured for monitoring and comparing signal amplitudes and phases of each of the radio frequency inlets.

8 Claims, 7 Drawing Sheets

(56) References Cited

U.S. PATENT DOCUMENTS

| | | | | |
|---|---|---|---|---|
| 2008/0129613 | A1* | 6/2008 | Ermutlu | H01Q 3/267 343/703 |
| 2012/0062440 | A1* | 3/2012 | Tasaki | H01Q 21/28 343/841 |
| 2013/0057447 | A1* | 3/2013 | Pivit | H01Q 3/267 343/853 |
| 2013/0229308 | A1* | 9/2013 | Pu | H01Q 3/40 342/373 |
| 2016/0043465 | A1* | 2/2016 | McDevitt | G01S 13/74 342/368 |
| 2018/0026379 | A1* | 1/2018 | Barker | H01Q 21/065 343/844 |
| 2018/0053997 | A1* | 2/2018 | Noto | H04B 1/04 |
| 2019/0326684 | A1* | 10/2019 | Achour | H01Q 13/22 |

* cited by examiner

BASE STATION ANTENNA

FIELD OF THE PRESENT DISCLOSURE

The present disclosure relates to the field of communication, and more particularly to a base station antenna.

DESCRIPTION OF RELATED ART

Large-scale antenna array is a key point of 5G communication. Multiple antenna units are divided into 1×2 or 1×3 base station antenna sub-arrays through a power division network, and are configured to form multiple beams through a beam-forming technology to serve different users and reduce mutual interference among users.

Therefore, how to achieve a good beam-forming effect and ensure that input signals at the input end of the antenna have a same amplitude-phase distribution, for realizing the beam-forming effect and the calculation accuracy of signal arrival azimuth, and meeting the 5G communication requirements, is a technical problem that need to be urgently solved by one ordinary skill in the art.

SUMMARY OF THE PRESENT DISCLOSURE

The present disclosure provides a base station antenna, aiming at providing a better 5G signal transmission.

In order to realize the above objective, the present disclosure provides a base station antenna, including a plurality of radiating unit arrays, a plurality of feeding modules arranged at front ends of the radiating unit arrays, and a calibrating module; wherein, each radiating unit array includes a plurality of radiating units; each feeding module includes a power division network and a radio frequency inlet which are arranged at the front end of one of the radiating unit arrays in sequence, and the power division network is configured for allocating an input power from the radio frequency inlet to each radiating unit of the radiating unit array; the calibrating module includes a plurality of directional couplers and combiners arranged at front ends of the directional couplers, a coupling end of each directional coupler connected with the radio frequency inlet is defined as a coupler input terminal, a coupling end of each directional coupler connected with the combiner is defined as a coupling terminal, and the calibrating module is configured for monitoring and comparing signal amplitudes and phases of each of the radio frequency inlets.

In some embodiments, a through terminal of each directional coupler communicates with an input terminal of the corresponding power division network.

In some embodiments, an isolating terminal of each directional coupler is matched with one resistor of 50 ohms.

In some embodiments, the combiner includes a combined output port, a plurality of combined input ports connected with the coupling terminals of the directional couplers, and a multistage combiner for connecting the combined output port with the corresponding combined input port.

In some embodiments, the feeding module and the calibrating module are integrally arranged on a circuit board, the circuit board includes a power division network signal line layer, a first substrate, a first ground layer, a second substrate, a calibrating module signal line layer, a third substrate, and a second ground layer, which are sequentially stacked.

In some embodiments, the power division network signal line layer, the first substrate and the first ground layer are formed on a double-sided PCB board, the calibrating module signal line layer, the third substrate and the second ground layer are formed on another double-sided PCB board, and the second substrate is an adhesive board.

In some embodiments, the base station antenna includes 64 radio frequency inlets and six stages of combiners.

In some embodiments, the first substrate defines a first metal via hole, and the power division network signal line layer is electrically connected with the calibrating module signal line layer through the first metal via hole.

Compared with the related art, the base station antenna of the present disclosure has the following advantages:

The base station antenna has a plurality of radiating unit arrays, a plurality of feeding modules arranged at front ends of the radiating unit arrays, and a calibrating module. Each radiating unit array includes a plurality of radiating units. Each feeding module includes a power division network and a radio frequency inlet which are arranged at the front end of one of the radiating unit arrays in sequence, and the power division network is configured for allocating an input power from the radio frequency inlet to each radiating unit of the radiating unit array. The calibrating module includes a plurality of directional couplers and combiners arranged at front ends of the directional couplers, a coupling end of each directional coupler connected with the radio frequency inlet is designed as a coupler input terminals, the coupling end of each directional coupler connected with the combiner is designed as a coupling terminals, and the calibrating module is configured for monitoring and comparing signal amplitudes and phases of the radio frequency inlets.

The calibrating module is configured to monitor and compare the signal amplitude and phase of each radio frequency inlet, so as to ensure the same amplitude-phase distribution of the input signals at the input end of the antenna, achieve the beam-forming effect and the calculation accuracy of signal arrival azimuth, and to meet the 5G communication requirements.

DETAILED DESCRIPTION OF THE EXEMPLARY EMBODIMENT

Figure 1:
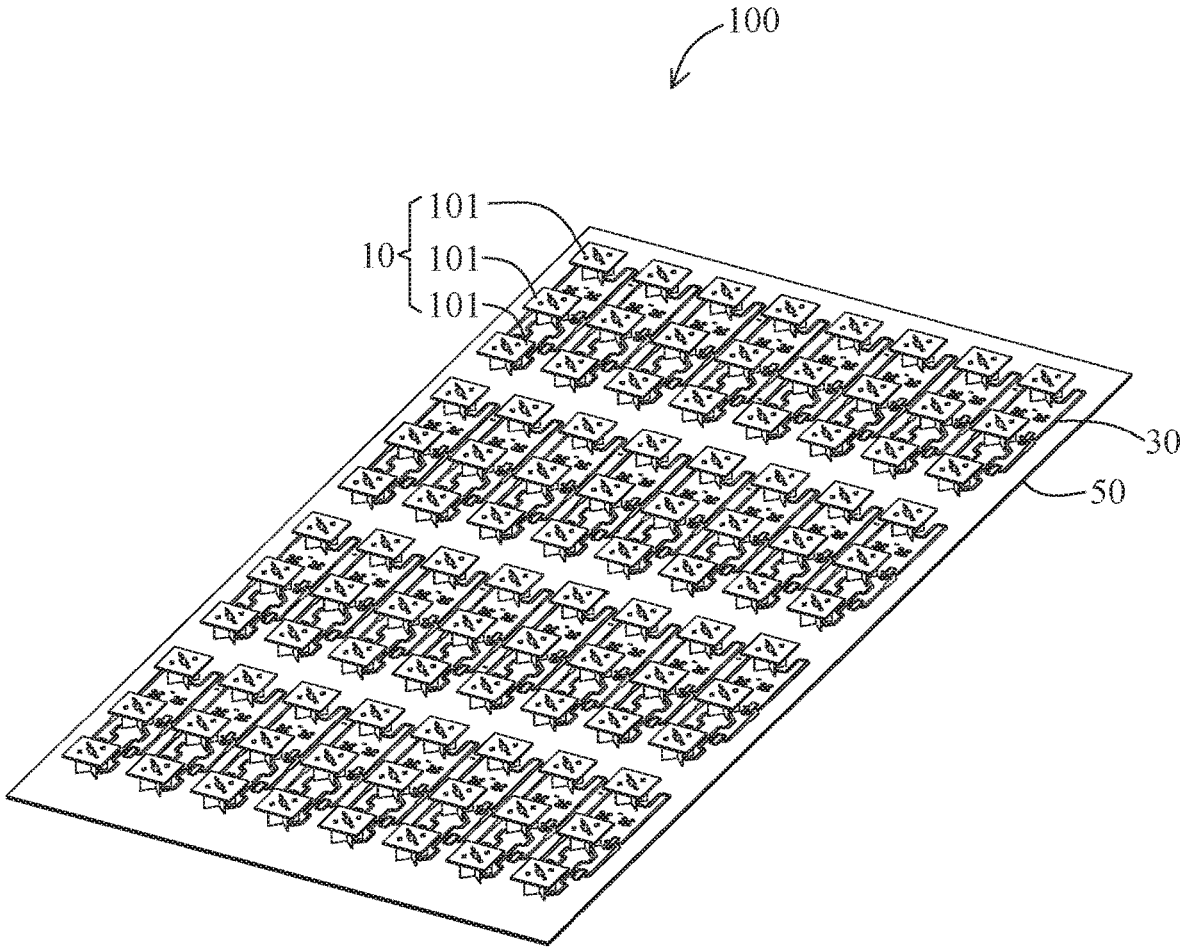
FIG. 1 is a perspective view of a base station antenna of the present disclosure.
Figure 2:
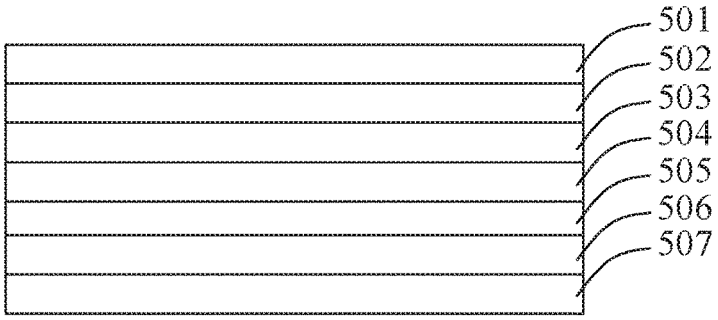
FIG. 2 is a cross-sectional view of a circuit board.
Figure 3:
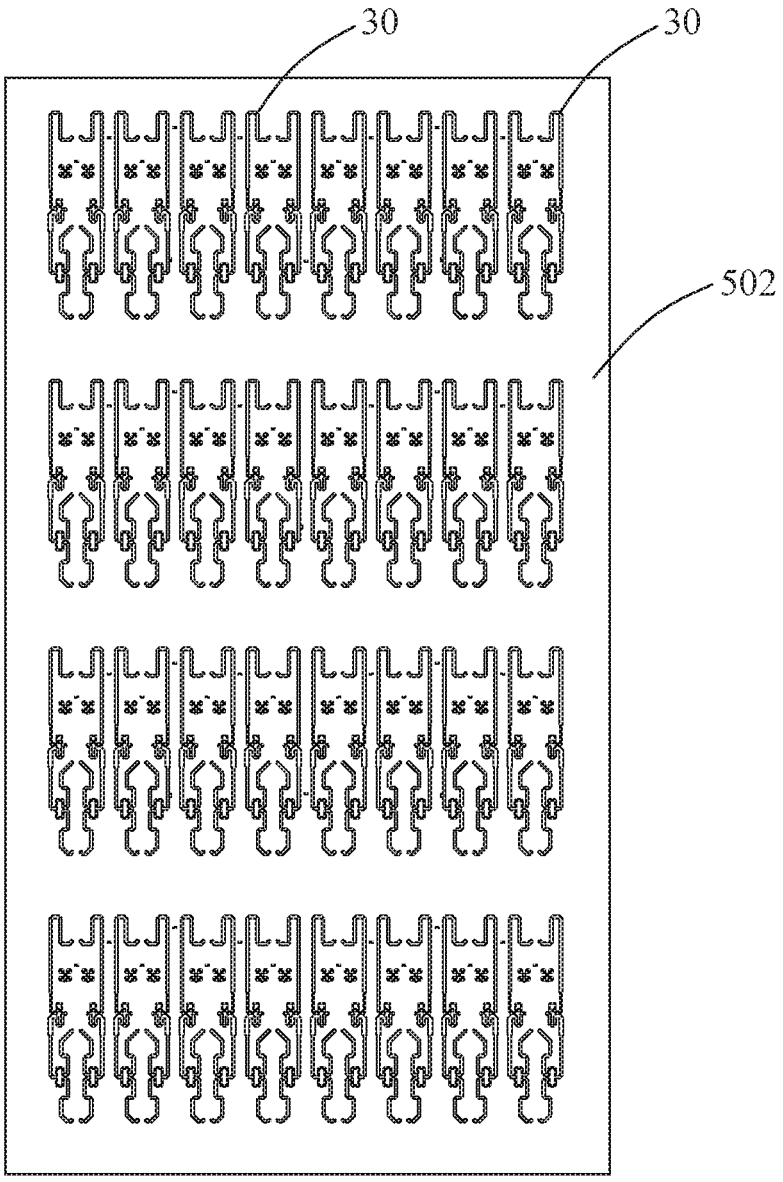
FIG. 3 is a schematic view of a feeding module formed on the circuit board.

In order to make the purpose, technical solutions and advantages of the present disclosure clearer, the present disclosure will be further described in detail with reference to the drawings and embodiments. It should be understood that the specific embodiments described herein are only used to explain the present disclosure, and are not used to limit the present disclosure.

Referring to FIGS. 1 through 8, the present disclosure provides a base station antenna 100, which includes a plurality of radiating unit arrays 10, a plurality of feeding modules 30 arranged at front ends of the radiating unit arrays 10, and a calibrating module 40. The feeding modules 30 and the calibrating module 40 are integrated on a circuit board 50.

The circuit board 50 includes a power division network signal line layer 501, a first substrate 502, a first ground layer 503, a second substrate 504, a calibrating module signal line layer 505, a third substrate 506, and a second ground layer 507, which are sequentially stacked.

The power division network signal line layer 501, the first substrate 502, and the first ground layer 503 are formed on a double-sided PCB board. The calibrating module signal line layer 504, the third substrate 505, and the second ground layer 504 are formed on another double-sided PCB board. The second substrate 504 is an adhesive board. The feeding modules 30 are formed on the power division network signal line layer 501, and the calibrating module 40 is formed on the calibrating module signal line layer 504.

The first substrate 502 has a first metal via hole 5021, and the power division network signal line layer 501 is electrically connected with the calibrating module signal line layer 504 through the first metal via hole 5021.

Specifically, each radiating unit array 10 includes a plurality of radiating units 101. Each feeding module 30 includes a power division network 301 and a radio frequency inlet 302 which are sequentially arranged at the front end of one radiating unit array 10. An output end of the power division network 301 is electrically connected with the radiating unit 101, which is for allocating an input power from the radio frequency inlet 302 to each radiating unit 101 of the radiating unit array 10.

The first substrate 502 defines plugging holes 5023 corresponding to the radiating units 101, and the radiating units 101 are plugged into the plugging holes 5023 and electrically connected with the first ground layer 503 through the plugging holes 5023.

The calibrating module 40 includes a plurality of directional couplers 403 and combiners 401 arranged at front ends of the directional couplers 403. The directional coupler 403 includes a coupler input terminal 406 and a coupling terminal 409. The coupler input terminal 406 of the directional coupler 403 is electrically connected with the corresponding radio frequency inlet 302. That is, each directional coupler 403 is electrically connected with one radio frequency inlet 302, and the coupling end of the directional coupler 403 to the radio frequency inlet 302 is defined as the coupler input terminal 406. Further, the coupling terminal 409 of each directional coupler 403 is electrically connected with one corresponding combiner 401, that is, the coupling end of the directional coupler 403 to the combiner 401 is defined as the coupling terminal 409. The calibrating module 40 is configured for monitoring and comparing the signal amplitudes and phases of each of the radio frequency inlets 302.

In some embodiments, the directional coupler 403 further includes a through terminal 407 and an isolating terminal 408. The through terminal 407 of each directional coupler 403 is communicated with a power division input terminal 303 of corresponding power division network 301. The isolating terminal 408 of each directional coupler 403 is matched with one resistor, and a resistance value of the resistor can be set as required, for example, 50 ohms.

Figure 4:
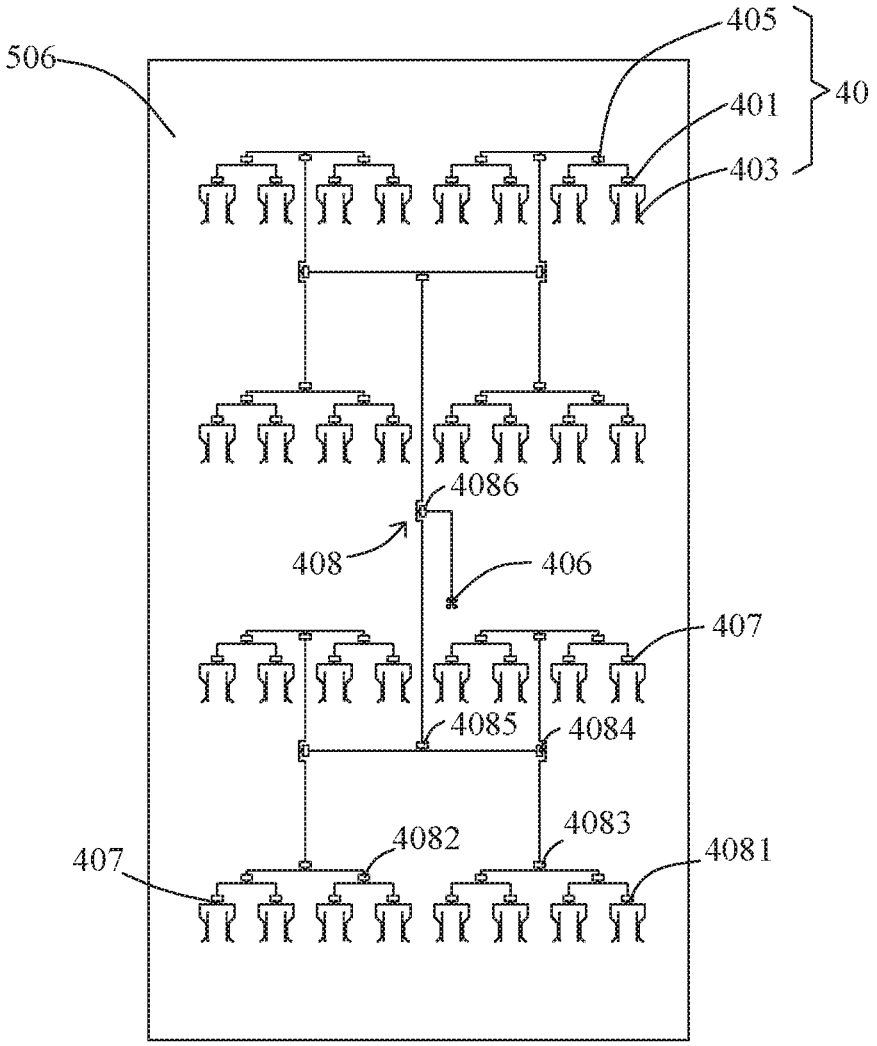
FIG. 4 is a schematic view of a calibrating module formed on the circuit board.

In some embodiments, the combiner 401 includes a combined output port 406, a plurality of combined input ports 407 connected with the coupling terminals 409 of the directional couplers 403, and a multistage combiner 408 for connecting the combined output port 406 with each combined input port 407, as shown in FIG. 4.

In some embodiments, the base station antenna 100 includes 64 radio frequency inlets 302 and six-stage combiners.

Figure 5:
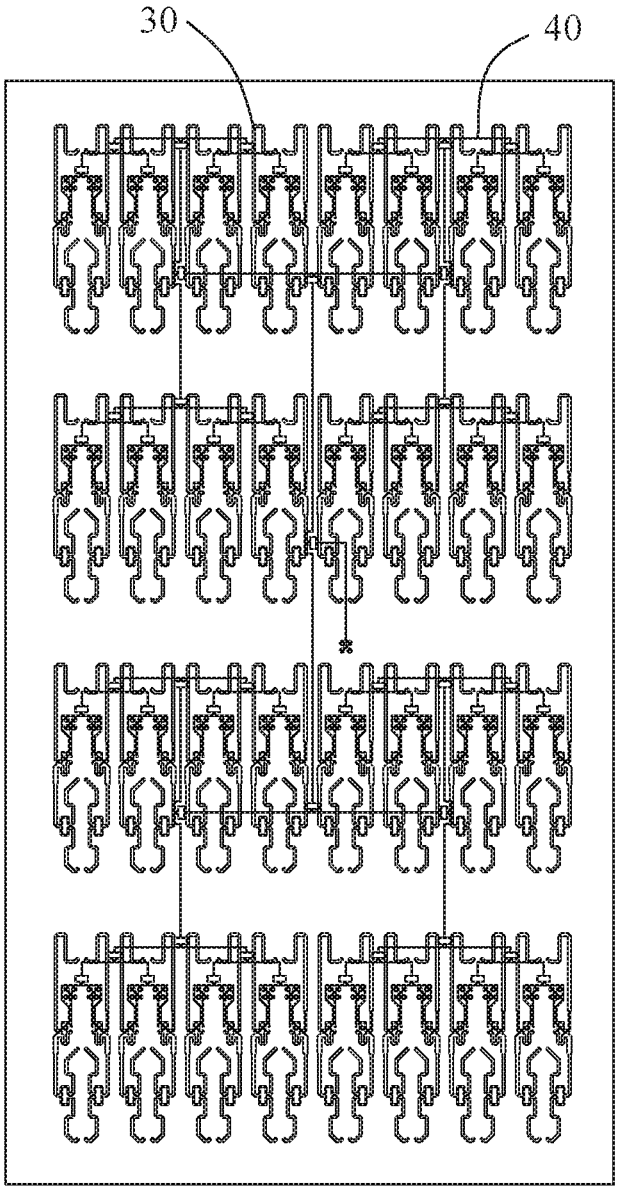
FIG. 5 is a logic diagram of an adaptation of the feeding module and the calibrating module.
Figure 6:
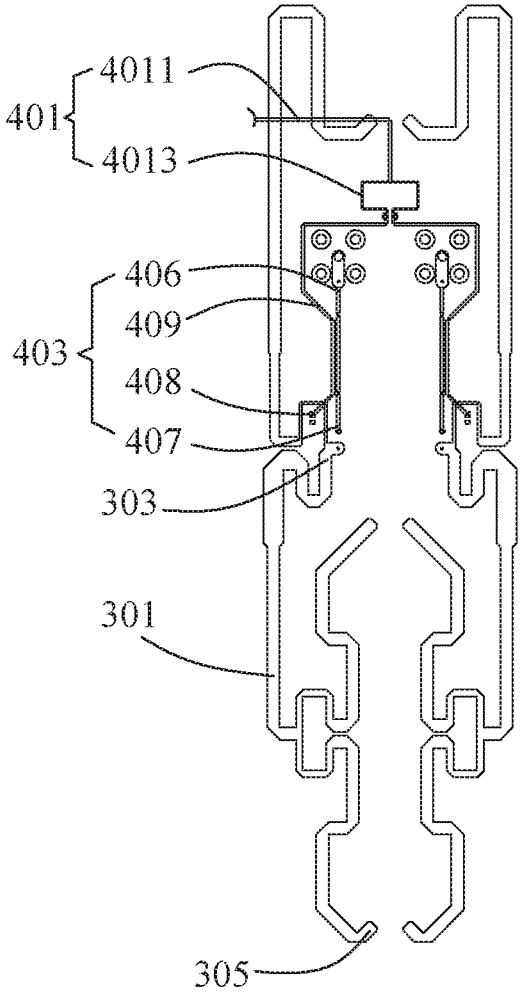
FIG. 6 is an partially enlarged schematic view of FIG. 5.
Figure 7:
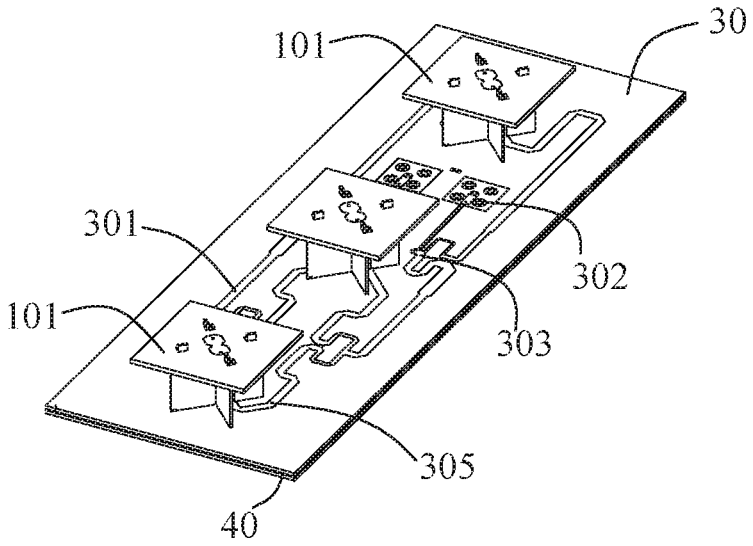
FIG. 7 is a perspective view of one of radiating unit arrays of the base station antenna.
Figure 8:
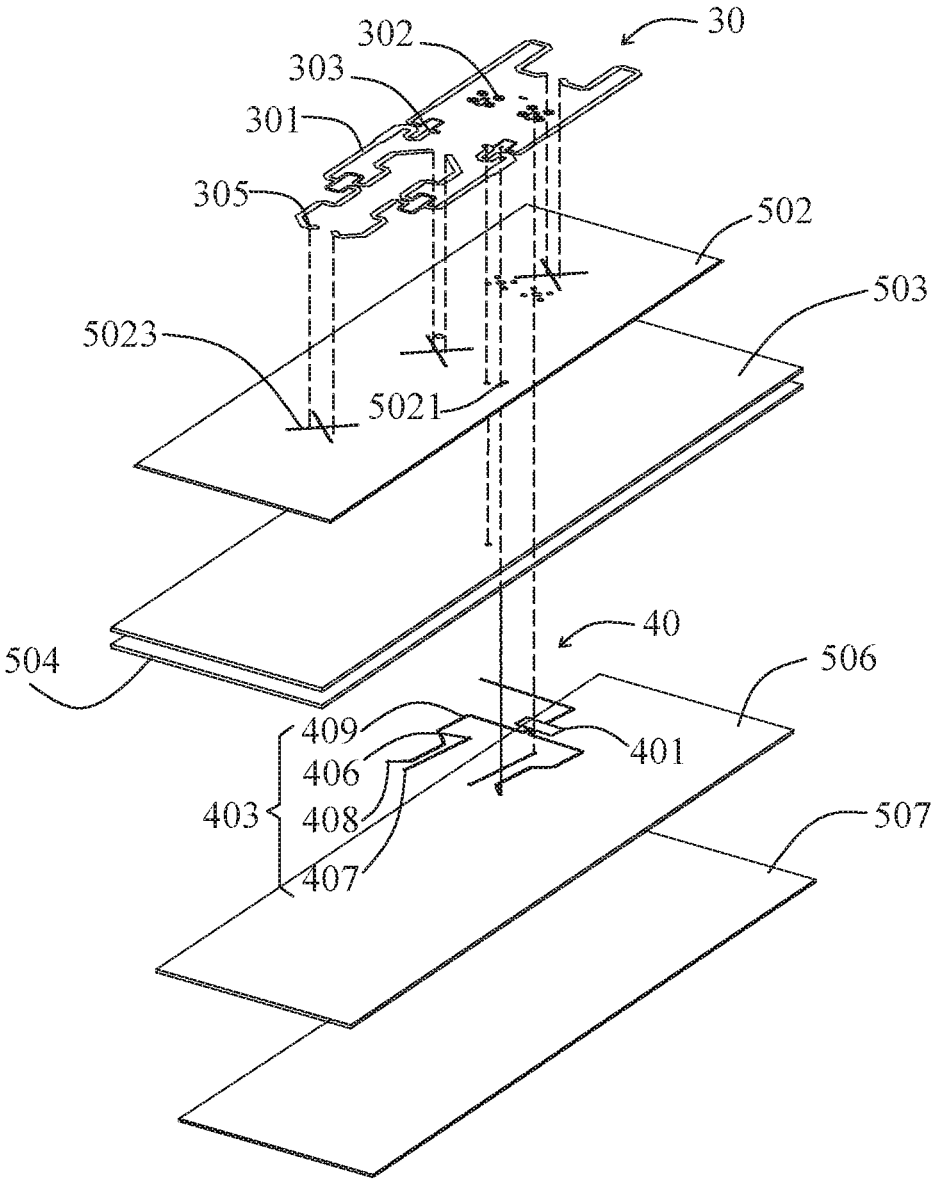
FIG. 8 is an exploded view of circuit board corresponding to one radiating unit array of the base station antenna.

Specifically, the base station antenna 100 includes 32 radiating unit arrays 10, and each radiating unit array 10 includes two radio frequency inlets 302. In order to monitor the signal amplitudes and phases of the 64 radio frequency inlets of the base station antenna 100, the directional couplers corresponding to the two radio frequency inlets of each radiating unit array 10 are cascaded by a first-stage combiner 4081, and each two cascaded first-stage combiners 4081 form a first sub-stage, and a second-stage combiner 4082 is cascaded with the first-stage combiner 4081 of the first sub-stage. Every two first sub-stages form a second sub-stage, and a third-stage combiner 4083 is cascaded with the second-stage combiner 4082 of the second sub-stage. Every two second sub-stages form a third sub-stage, and a fourth-stage combiner 4084 is cascaded with the third-stage combiner 4083 of the third sub-stage. Every two fourth sub-stages form a fifth sub-stage, and a fifth-stage combiner 4085 is cascaded with the fourth-stage combiner 4084 of the fourth sub-stage. Every two fifth sub-stages form a sixth sub-stage, and a sixth-stage combiner 4086 is cascaded with the fifth-stage combiner 4085 of the fifth sub-stage. Therefore, 32 radiating unit arrays 10 need to be cascaded through six-stage combiners, as shown in FIGS. 4 to 6.

Compared with the related art, the base station antenna of the present disclosure has the following advantages:

1. The base station antenna has a plurality of radiating unit arrays, a plurality of feeding modules arranged at front ends of the radiating unit arrays, and a calibrating module. Each radiating unit array includes a plurality of radiating units. Each feeding module includes a power division network and a radio frequency inlet which are arranged at the front end of one of the radiating unit arrays in sequence, and the power division network is configured for allocating an input power from the radio frequency inlet to each radiating unit of the radiating unit array. The calibrating module includes a plurality of directional couplers and combiners arranged at front ends of the directional couplers, a coupling end of each directional coupler connected with the radio frequency inlet is designed as a coupler input terminals, the coupling end of each directional coupler connected with the combiner is designed as a coupling terminals, and the calibrating module is configured for monitoring and comparing signal amplitudes and phases of the radio frequency inlets.

The calibrating module is configured to monitor and compare the signal amplitude and phase of each radio frequency inlet, so as to ensure the same amplitude-phase distribution of the input signals at the input end of the antenna, achieve the beam-forming effect and the calculation accuracy of signal arrival azimuth, and to meet the 5G communication requirements.

The description above is only some embodiments of the present disclosure. It should be pointed out here that for those of ordinary skill in the art, improvements can be made without departing from the inventive concept of the present disclosure, which are all within the scope of the present disclosure.

What is claimed is:

1. A base station antenna, comprising: a plurality of radiating unit arrays, a plurality of feeding modules arranged at front ends of the radiating unit arrays, and a calibrating module; wherein, each radiating unit array comprises a plurality of radiating units;

each feeding module comprises a power division network and a radio frequency inlet which are arranged at the front end of one of the radiating unit arrays in sequence, the power division network being configured for allocating an input power from the radio frequency inlet to each radiating unit of the radiating unit array;

the calibrating module comprises a plurality of directional couplers and combiners arranged at front ends of the directional couplers, a coupling end of each directional coupler connected with the radio frequency inlet being defined as a coupler input terminal, a coupling end of each directional coupler connected with the combiner being defined as a coupling terminal, and the calibrating module being configured for monitoring and comparing signal amplitudes and phases of each of the radio frequency inlets.

2. The base station antenna of claim 1, wherein a through terminal of each directional coupler communicates with an input terminal of the corresponding power division network.

3. The base station antenna of claim 1, wherein an isolating terminal of each directional coupler is matched with one resistor of 50 ohms.

4. The base station antenna of claim 1, wherein the combiner comprises a combined output port, a plurality of combined input ports connected with the coupling terminals of the directional couplers, and a multistage combiner for connecting the combined output port with the corresponding combined input port.

5. The base station antenna of claim 1, wherein the feeding module and the calibrating module are integrally arranged on a circuit board, the circuit board comprising a power division network signal line layer, a first substrate, a first ground layer, a second substrate, a calibrating module signal line layer, a third substrate, and a second ground layer, which are sequentially stacked.

6. The base station antenna of claim 5, wherein the power division network signal line layer, the first substrate, and the first ground layer are formed on a double-sided PCB board, the calibrating module signal line layer, the third substrate, and the second ground layer are formed on another double-sided PCB board, and the second substrate is an adhesive board.

7. The base station antenna of claim 1, comprising 64 radio frequency inlets and six stages of combiners.

8. The base station antenna of claim 6, wherein the first substrate defines a first metal via hole, and the power division network signal line layer is electrically connected with the calibrating module signal line layer through the first metal via hole.

* * * * *